United States Patent [19]

Lee et al.

[11] Patent Number: 5,030,376

[45] Date of Patent: Jul. 9, 1991

[54] DELTA PHASE SOAP AND NON-SOAP DETERGENT COMPOSITION

[75] Inventors: Robert S. Lee, Bebington; Craig D. Adam, Stockport; Geoffrey Irlam, Birkenhead, all of England

[73] Assignee: Lever Brothers Company, division of Conopco, Inc., New York, N.Y.

[21] Appl. No.: 587,473

[22] Filed: Sep. 19, 1990

Related U.S. Application Data

[63] Continuation of Ser. No. 420,670, Oct. 10, 1989 abandoned, which is a continuation-in-part of Ser. No. 179,090, Apr. 8, 1988 abandoned.

[30] Foreign Application Priority Data

Apr. 13, 1987 [GB] United Kingdom ..... 8708829

[51] Int. Cl.[5] ..... C11D 9/00

[52] U.S. Cl. ..... 252/108; 252/121; 252/132; 252/134; 252/DIG. 16

[56] References Cited

U.S. PATENT DOCUMENTS

| | | | |
|---|---|---|---|
| 2,749,315 | 6/1956 | Faier | 252/117 |
| 2,894,912 | 7/1959 | Geitz | 252/121 |
| 3,376,229 | 4/1968 | Haass et al. | 252/117 |
| 3,523,909 | 8/1970 | Bradley et al. | 252/370 |
| 3,835,058 | 9/1974 | White | 252/121 |
| 3,879,309 | 4/1975 | Gatti et al. | 252/117 |
| 3,941,712 | 3/1976 | Ferrara et al. | 252/126 |
| 4,260,507 | 4/1981 | Barrett | 252/121 |
| 4,479,884 | 10/1984 | Clarke et al. | 252/132 |
| 4,517,107 | 5/1985 | Clarke et al. | 252/108 |
| 4,663,070 | 5/1987 | Dobrovolny et al. | 252/121 |
| 4,695,395 | 9/1987 | Caswell et al. | 252/121 |
| 4,707,288 | 11/1987 | Irlam et al. | 252/121 |

FOREIGN PATENT DOCUMENTS

| | | |
|---|---|---|
| 2118055 | 10/1983 | United Kingdom . |
| 2118056 | 10/1983 | United Kingdom . |
| 2118854 | 11/1983 | United Kingdom . |
| 2119666 | 11/1983 | United Kingdom . |

OTHER PUBLICATIONS

"Baileys Industrial Oil and Fat Products", pp. 523–526 (4th Edition, Ed. D. Swern).

Industrial and Engineering Chemistry 35, pp. 1005–1012 (1943) by Ferguson et al.

Proc. Nat. Acad. Sci. U. S. 28, pp. 526–529 (1942) and 31, pp. 226–233 (1945) by Buerger and co-workers.

*Primary Examiner*—Paul Lieberman

*Assistant Examiner*—Cynthia Leslie

*Attorney, Agent, or Firm*—Milton L. Honig

[57] ABSTRACT

A cleaning composition for example in the form of a bar comprises at least 10 wt % fatty acid soap and at least 5 wt % non-soap detergent active wherein at least some of the said soap is in the delta phase. The non-soap detergent can for example be acyl isethionate. The presence of delta phase soap improves the properties of for example the bar comprising the composition. The composition can be made by subjecting to high shear energy a mixture maintained at a temperature of less than 40° C. and containing at least 10 wt % fatty acid soap, at least 5 wt % non-soap detergent active and sufficient moisture to ensure the generation of at least some soap in the delta phase.

8 Claims, 3 Drawing Sheets

Figure 1:
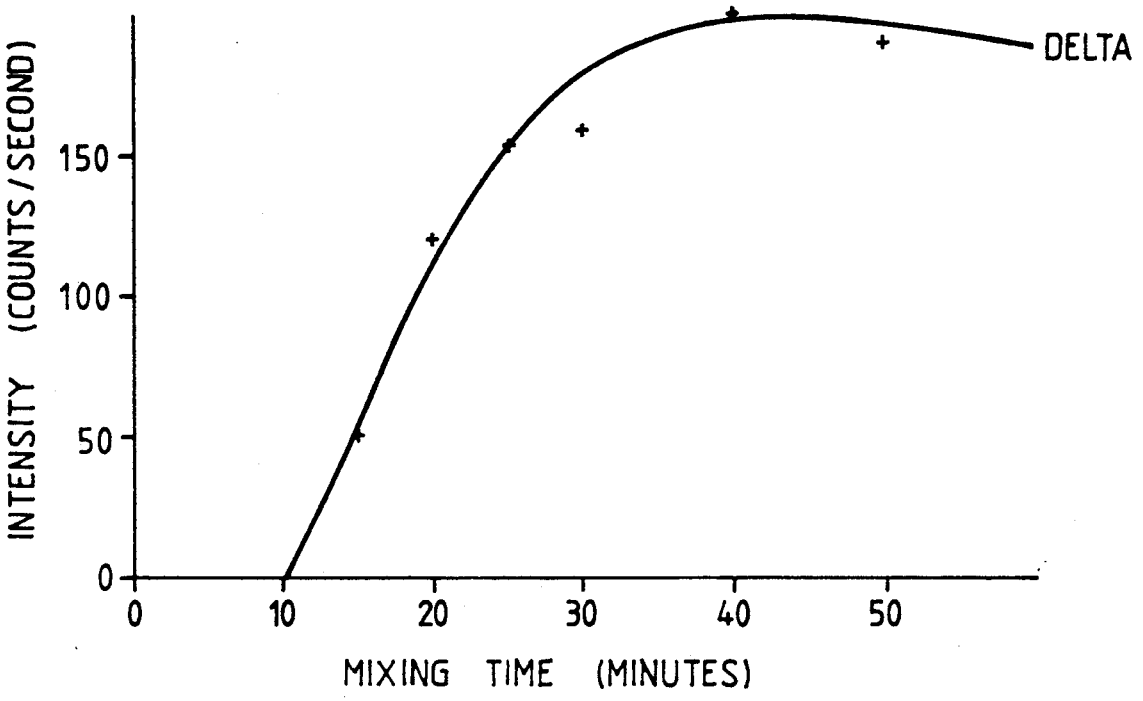

DELTA PHASE SOAP AND NON-SOAP DETERGENT COMPOSITION 10, 1989, now abandoned which is a continuation-in-part of Ser. No. 179,090, filed Apr. 8, 1988, now abandoned.

The present invention relates to cleaning compositions, particularly although not exclusively cleaning compositions in solid form. Notably, it is concerned with compositions in the form of bars for personal washing. However, other solid forms are not excluded.

There have been various proposals for bars which contain both soap and a non-soap detergent. Examples are U.S. Pat Nos. 2,894,912, 2,749,315, 3,376,229, 3,879,309 and 4,260,507. In such bars, user-perceivable properties (such as the tendency to become mushy at the surface when left in a little water) may be inferior to the corresponding properties of ordinary toilet soap.

It has been known for many years that soaps display a phase structure. This is discussed in Volume 1 of "Bailey's Industrial Oil and Fat Products" (4th edition, editor D. Swern), by Ferguson in Industrial and Engineering Chemistry 35, 1005 (1943), and by Buerger and co-workers in Proc. Nat. Acad. Sci. US 28, 526 (1942) and 31, 226 (1945).

U.S. Pat. No. 3,523,909 (Bradley) discloses a process for improving certain properties of soap compositions by removing omega phase (also known as kappa phase).

The modification of soap phase structure by means of shear is described in our UK published patent application 2118854A. Such treatment, to improve properties, is also disclosed in our UK 2118055A, 2118056A and 2119666A. These applications mention briefly the theoretical possibility of including a "non-interfering" quantity of non-soap detergent, which by implication is only a token amount of less than 5 wt % of the total composition.

According to one aspect of the present invention, there is provided a cleaning composition comprising:

(a) a fatty acid soap in an amount which is at least 10 wt % of the composition; and (b) a non-soap detergent active in an amount which is at least 5 wt % of the composition, wherein at least some of the said soap is in the delta phase.

By soap in the delta phase we mean soap having a phase structure which on X-ray diffraction analysis gives rise to three peaks at 19.50 degrees (4.55 Å), 23.00 degrees (3.86 Å) and 25.00 degrees (3.56 Å) respectively whose summed total intensity is at least 50 counts/-second (Cu K alpha radiation of wavelength 1.5418 Å).

In the absence of external reference standards our method for assessing phases present in the cleaning composition was derived from the method without standards described by Klug HP and Alexander LE "X-ray diffraction procedures for polycrystalline and amorphous materials" New York, London: John Wiley, 1954.

The X-ray diffraction technique is widely used as a method for the qualitative analysis of crystalline materials. By utilising the fact that a powdered crystalline phase gives a unique "fingerprint" X-ray diffraction spectrum, standards can be used for phase identification. The widespread use of well-stabilised X-ray generators, proportional counter detection and high resolution diffractometers, usually with computer control, means that reliable intensity data can be obtained for each characteristic peak in the spectrum of a crystalline phase. The intensity is related to the weight fraction of that phase present in the sample under investigation, and can be quantified using several approaches described by Klug HP and Alexander LE in the reference mentioned above.

An X-ray diffractometer (supplied by Philips) coupled with computer processing of the spectra was used to give relative quantification of the non-soap detergent active, soap in the delta phase and soap rn a partially disordered phase. For the case where the non-soap detergent active is fatty acyl isethionate the following three standard spectra were identified:

1. A spectrum derived from fatty acyl isethionate obtained from a commercial source, namely a Dove toilet bar ex Lever Bros. Co. USA. The maximum intensity of this diffraction pattern, at the peak at 21.60 degrees (4.11 Å), defines the amount of fatty acyl isethionate present in an unknown sample.

2. A simulated spectrum of partially disordered soap derived from an experimental spectrum with the individual peak intensities being refined in the calculation. The intensities of the peaks at 19.34 degrees (4.59 Å) and 22.65 degrees (3.92 Å) were summed to give the quantification parameter for the partially disordered soap phase. The peak width was fixed at 2 degrees.

3. A simulated spectrum of delta phase soap derived from experimental work with individual peak refinement for each peak. The three peaks at 19.50 degrees (4.55 Å), 23.00 degrees (3.86 Å) and 25.00 degrees (3.56 Å) were summed for quantification. The peak width was fixed at 0.7 degrees.

The above values were obtained using an X-ray tube which, in a separate experiment, gave an intensity for the strongest peak (2.09 Å) in the corundum spectrum (alpha-A1203, BDH Analytical Grade, approx. 0.3 μm) of 840 counts/second (slit settings, divergent-1°, receiving −0.1 mm).

The above method provides relative quantification of the Dove toilet bar, partially disordered soap, and delta phase soap contributions to the diffraction pattern but does not quantify on a weight basis as pure single phase reference standards are not available. The method is however reliable and reproducible and thus provides a means for detecting the presence or absence of delta phase soap in the cleaning compositions comprising a mixture of soap and a non-soap detergent.

In order to measure their diffraction pattern samples were prepared by finely dividing about 1 g of sample material and pressing it into a standard sample holder by the "back fill" method so as to form a disc of the material 20 mm in diameter and approximately 3 mm thick and hence effectively infinitely thick to X-rays. The disc was illuminated with X-rays (Cu Kalpha) of wavelength 1.5418 Ågenerated with instrument settings of 50 kv and 40 mA. Each sample was scanned between 28 values within the range 16 to 40 degrees with a counting time of 7.5 seconds for each value. The resultant counts and their respective angles were sent to a remote terminal where they were stored on disc and plotted in the form of an intensity v. angle graph.

A least-squares minimisation routine was employed to fit the observed spectrum to a linear combination of the standard spectra. After refinement over the standard section of the spectrum between 16 and 40 degrees, a relative proportion was calculated for each peak intensity. Absolute peak intensities in counts/second were computed by multiplying the maximum intensity for each measured peak by the relative proportion for that peak. In practice experimental data showed a constant background intensity due to fluorescence and other factors of 75 counts/second which was deducted from the maximum intensities.

Thus the above described method can readily be employed in order to establish the presence or absence of delta phase soap. A minimum threshold of 50 counts/second intensity for the three peaks attributed to delta phase soap is required by the present compositions to account for any sources of error to be taken on fitting the measured spectrum to the simulated spectra.

The present compositions suitably contain a non-soap detergent active selected from the group comprising $C_8$ to $C_{18}$ fatty acyl isethionates, alkane sulphonates, ether sulphates, alkyl benzene sulphonates, alkyl sulphates, olefin sulphonates, ethoxylated alcohols and mixtures thereof. Suitably for a personal washing composition it is a fatty acyl isethionate the amount of non-soap detergent active will be at least 5 weight percent, preferably at least 10 weight percent, and optimally at least 15 weight percent.

By "fatty acid soap" is meant the alkali metal or alkanol ammonium salts of aliphatic alkane- or alkene monocarboxylic acids. Sodium, potassium, mono-, di- and triethanol ammonium cations, or combinations thereof, are for example suitable for use in the present compositions. In general sodium soaps are preferred. From about 1% to about 25% of the soap may however suitably be potassium soaps.

The soaps employed are preferably the well-known alkali metal salts of natural or synthetic aliphatic (alkanoic or alkenoic) acids having a carbon chain length of about 12 to 20 carbon atoms, preferably about 12 to 18 carbon atoms. Soaps prepared from natural triglyceride sources are preferred. The sources employed in any one instance will depend on the soap properties desired and the local availability of the raw materials.

Soaps having carbon chain lengths predominantly in the lower end of the C12 to 20 range can be suitable to use alone or in combination with soaps having carbon chain lengths predominantly in the upper end of the C12 to C20 range. Examples of triglyceride sources providing soaps with carbon chain lengths predominantly in the lower end of the C12 to C20 range include coconut oil, palm kernel oil, babassu oil, ouricuri oil, tucum oil, cohune oil, murumuru oil, jaboty kernel oil, khakan kernel oil, dika nut oil and ucuhuba butter. Each of these triglyceride sources is a tropical nut oil having at least 50% of its total fatty acid composition in the form of lauric and/or myristic acid.

Examples of triglyceride sources providing soaps with carbon chain lengths predominantly in the higher end of the C12 to C20 range include tallow, palm oil, rice bran oil and non-tropical nut oils such as groundnut oil, soyabean oil and rapeseed oil as well as their hydrogenated derivatives. In each of the just listed fats and oils the fatty acids predominantly present have a carbon chain length of 16 or more.

The soap mixture selected for use in the present compositions preferably has at least 85% of its content of C12 to C18 carbon length. A preferred mixture is prepared from coconut oil and tallow, suitably comprising 15 to 20 wt % coconut oil and 80 to 85 wt % tallow. Such mixtures contain about 95% fatty acids having carbon chain lengths in the range C12 to C18.

The soaps may contain unsaturation in accordance with commercially acceptable standards. Excessive unsaturation is normally avoided.

Soaps may be made by the classic kettle boiling process or by modern continuous soap manufacturing process wherein natural fats and oils such as tallow or coconut oil or their equivalents are saponified with an alkali metal hydroxide using procedures well known to those skilled in the art. Alternatively the soaps may be made by neutralising the fatty acids with an alkali metal hydroxide or carbonate.

Preferably fatty acid soap is present in the composition in an amount between 20 and 80 wt %, more preferably between 40 and 60 wt %. Preferably the non-soap detergent active is present in the composition in an amount between 10 and 60 wt %, more preferably between 15 and 40 wt %.

The presence of delta phase soap in the present compositions can lead to a composition having improved lather. When the composition is in the solid phase in the form of a bar, the presence of the delta phase soap can lead to a product having reduced mush tendency. The amount of delta phase present in order for the consumer to perceive a noticeable change in the composition's gross properties may vary from one product to the next. As explained above however, the present invention requires a minimum amount of delta phase to be present such that an X-ray diffraction measurement of at least 50 counts/second is given for the three peaks mentioned. Preferably however sufficient fatty acid soap is present in the delta phase to yield an X-ray diffraction measurement of at least 100 counts/second, more preferably from at least 150 counts/second up to 250 counts/second, for the three peaks identified above.

The present detergent compositions can contain a variety of other ingredients. These include free fatty acids, fillers, bacteriocidal agents, fluorescers, dyes and perfumes. Suitably the present compositions can contain 1 to 20 wt % free fatty acids with respect to the total compositions. Examples of suitable free fatty acids include lauric acid, myristic acid, palmitic acid, stearic acid and mixtures thereof. A preferred source of free fatty acids is coconut oil.

Electrolyte can suitably be present in the composition in an amount between 1 and 6 wt % with respect to the total composition. Examples of suitable electrolytes include sodium isethionate, sodium chloride, sodium sulphate, sodium carbonate and mixtures thereof.

The present composition is not limited to any particular technique for putting soap into the delta phase. A suitable technique for this purpose is however to subject a mixture comprising soap and a non-soap detergent active in the required proportions to substantial shear working at a temperature below 40° C. and with a sufficient level of moisture present. Substantial shear working under temperature controlled conditions can conveniently be achieved by use of a cavity transfer mixer. Examples of suitable cavity transfer mixers are described in our UK published applications 2119666A and 2118854A. Alternatively, other forms of mixer applying high shear can be employed. The temperature of the composition must however be maintained below 40° C., preferably below 35° C., more preferably below 30° C. In order to achieve such temperatures cooling of the mixer employed will generally be required in order to remove heat generated by the shear work done.

According to another aspect of the present invention there is provided a process for making a cleaning composition comprising subjecting to high shear energy a mixture maintained at a temperature of less than 40° C. and containing at least 10 wt % fatty acid soap, at least 5 wt % non-soap detergent active and sufficient moisture to ensure the generation of at least some soap in a delta phase.

Preferably the mixture is subjected to high shear energy by passage through a cavity transfer mixer. Once the composition containing delta phase soap is formed the composition is suitably milled, optionally dried for example tray dried, plodded and stamped into bars. If desired other forms of the composition may be prepared for example, sheets, flakes, powder or granules. Details of suitable cavity transfer mixers are given above. Alternatively, other forms of mixer applying high shear can be employed.

During the process the temperature of the mixture must be maintained below 40° C., preferably below 35° C., more preferably 30° C. Cooling of any high shear mixer employed will generally be required in order to remove heat generated by the shear work done.

We have found that in order to generate delta phase by means of the present process it is essential to have a certain minimum amount of moisture present. We have also found that the minimum amount required is dependent on the amount of electrolyte present in the composition. Thus for example we have found that a minimum content of 11 wt % water in the composition in the presence of 5.43 wt % electrolyte with respect to the total composition is required, whereas a minimum content of only 8 wt % water is required when the composition contains only 2.2 wt % electrolyte. The maximum amount of water which can be present will similarly vary from composition to composition and will be determined by the saturation point of each composition as well as the form that the composition takes. Generally though a maximum amount will preferably be 20 wt %, more preferably 16 wt %, with respect to the total composition.

We have not discovered any simple relationship between the amount of electrolyte present and the minimum amount of water required in order to achieve delta phase soap by the present process. Knowing however that a certain minimum amount of moisture is required it becomes a relatively simple matter to determine the effective quantity required in any one case. Generally though the composition preferably contains at least 8 wt % water.

Embodiments of the present invention will now be described by way of example only with reference to the following Examples and accompanying drawings wherein:

FIGS. 1 to 6 are plots of a variety of working conditions of the present compositions against intensity in counts per second of the X-ray diffraction peaks attributable to the presence of soap delta phase.

EXAMPLE 1 TO 3

Batches of detergent composition of the formulation given in Table I below were subjected to high shear working under a variety of conditions.

TABLE I

| | wt % |
|---|---|
| Fatty acid sodium soap | 51 |
| Sodium fatty acyl isethionate | 22 |
| Free fatty acids | 8 |
| Sodium isethionate | 5 |
| Sodium chloride | 0.5 |
| Water | 11.5 |
| Remainder | 2 |

The fatty acid soap consisted of a mixture of tallow and coconut soaps in the proportion of tallow to coconut of 82:18. The fatty moiety of the fatty acyl isethionate was derived from coconut oil. The free fatty acids were a mixture of stearic acid and coconut acids in the proportion of stearic acid to coconut acid of 84:16. The remainder included dye, perfume and antioxidants.

EXAMPLE 1

A 200 g batch of the composition at a temperature of at least 60° C. was blended in a Winkworth sigma blade mixer with a little water so as to yield a homogenised blend containing 15 wt % water. The mixing chamber was temperature controlled and made of stainless steel. The speed of blade rotation was fixed at 30rpm to ensure a steady work input.

The temperature of the composition was lowered to and maintained at 25° C. and the batch was worked for 60 minutes. During the working, samples were removed at 5 minute intervals and subjected to X-ray diffraction in order to assess the amount of delta phase soap present. The results are shown graphically in FIG. 1 which is a plot of mixing time in minutes against intensity in counts per second of the X-ray diffraction peaks attributable to the presence of soap delta phase. As can be seen, delta phase soap content increased with the amount of shear energy to which the composition was subjected, plateauing off after about 40 minutes.

EXAMPLE 2

Five batches of the above composition were employed in the present example. One batch was air dried to a water content of 11 wt % water. Each of the remaining four batches was worked in a Winkworth sigma blade mixer at a temperature of 60° C. with varying amounts of extra water added so as to generate samples containing 12.4 wt %, 12.7 wt %, 14.4 wt % and 15.5 wt % moisture respectively.

Each sample was then worked in the Winkworth mixer for 45 minutes with the blade rotation fixed at 30 rpm and the temperature of the composition maintained at 25° C.

Figure 2:
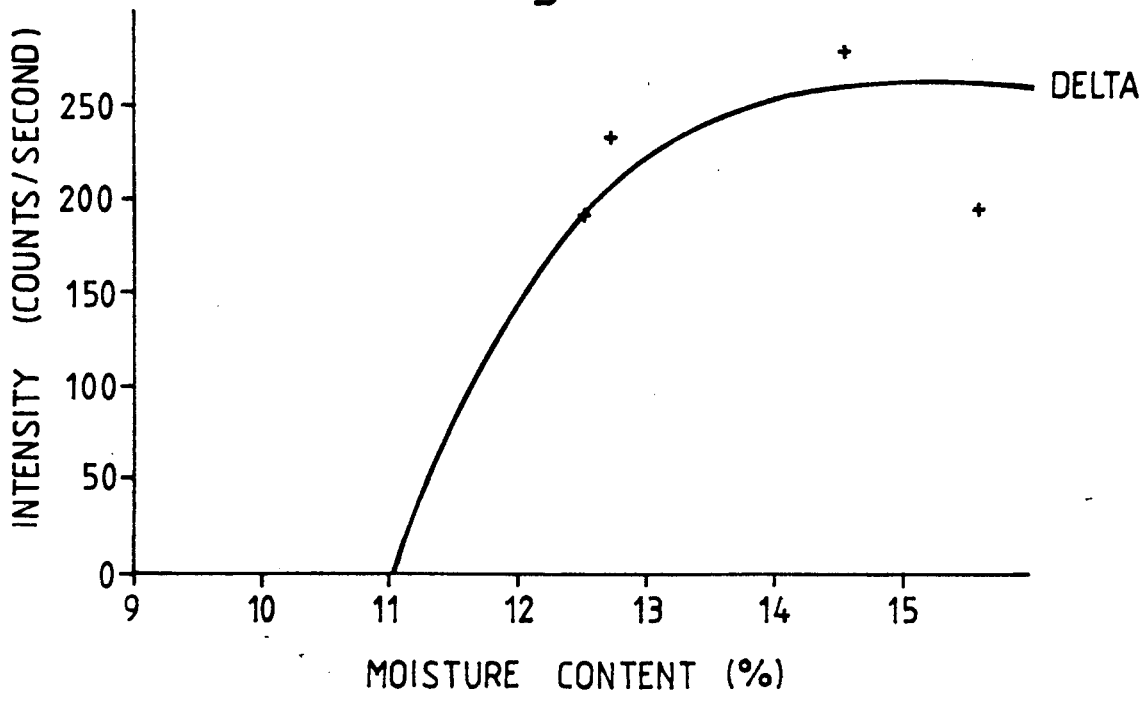

The results are shown graphically in FIG. 2 which is a plot of water content of each sample against intensity in counts per second of the X-ray diffraction peaks attributable to the presence of soap delta phase. As can be seen delta phase soap content was only present when the moisture content was in excess of 11 wt %.

EXAMPLE 3

Seven batches of the above composition were prepared containing 15 wt % moisture by admixing the composition at 60° C. with extra water in a Winkworth sigma blade mixer at 30 rpm.

Each batch was then worked in the Winkworth sigma blade mixer operating at 30rpm for 45 minutes whilst maintaining the composition at the following respective temperatures: 25° C., 30° C., 35° C., 40° C., 50° C., 60° C. and 70° C.

Figure 3:
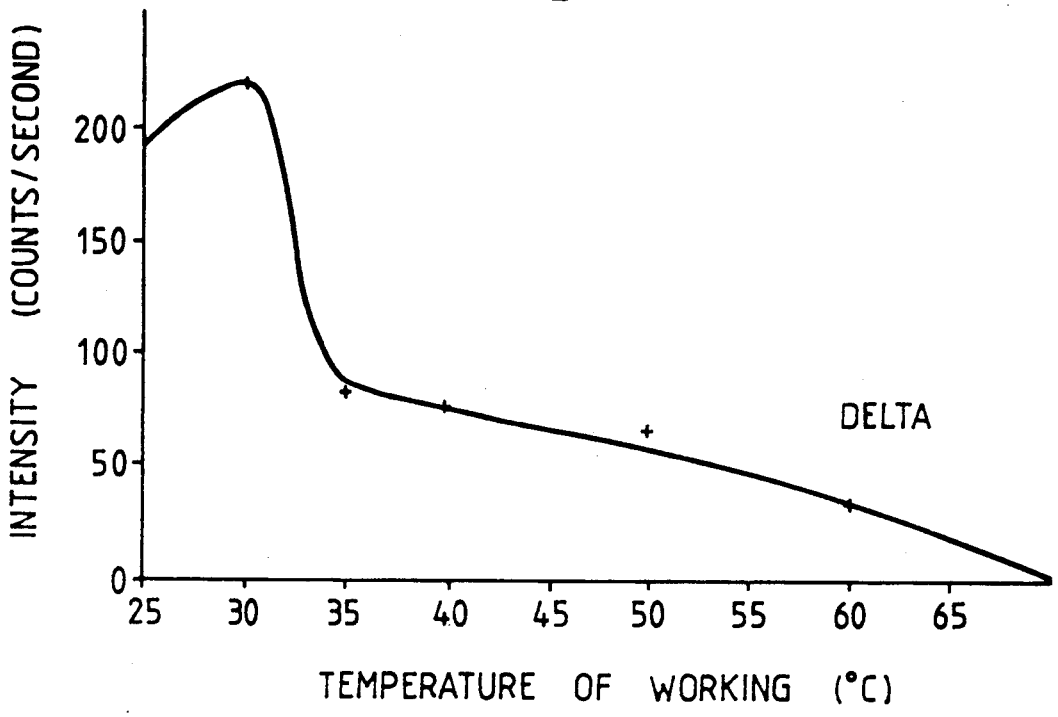
Figure 4:
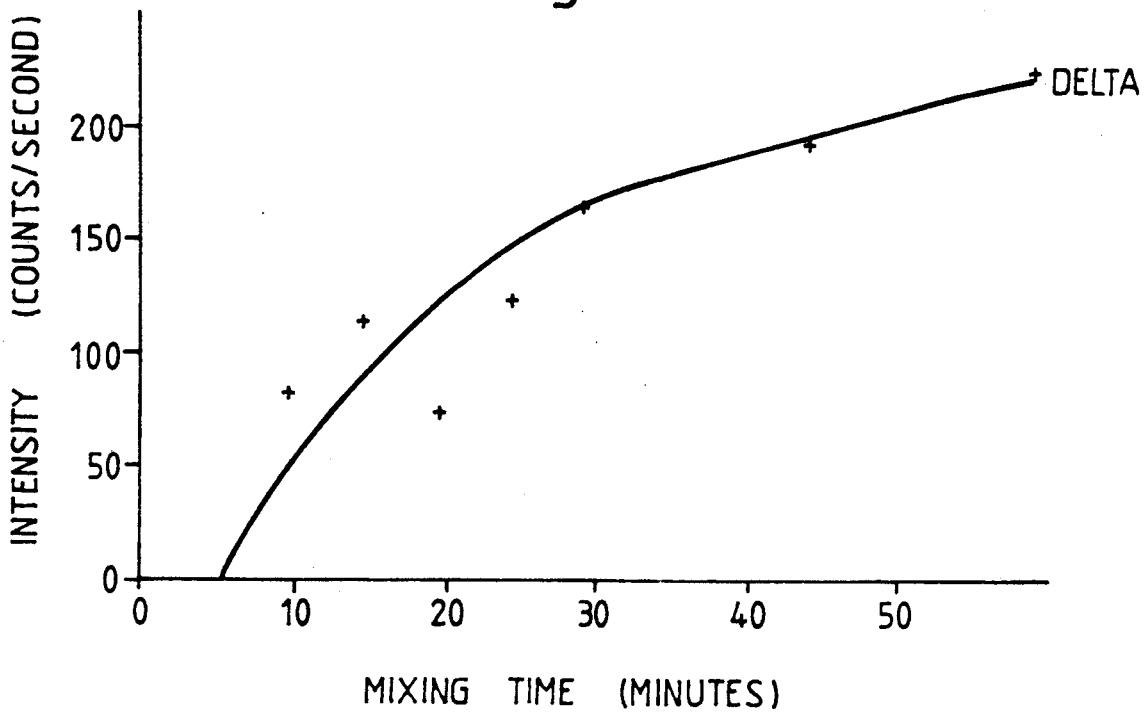

The results are shown graphically in FIG. 3 which is a plot of the temperature of working of each batch in °C. against the intensity in counts per second of the X-ray diffraction peaks attributable to the presence of soap delta phase. As can be seen for the present composition a significant decline in the production of delta phase occurred at temperatures above about 35° C.

EXAMPLES 4 TO 6

Batches of a detergent composition of the formulation given in Table II below were subjected to high shear working under a variety of conditions.

TABLE II

| | wt % |
|---|---|
| Fatty acid sodium soap | 54 |
| Sodium fatty acyl isethionate | 23 |
| Free fatty acids | 9 |
| Sodium isethionate | 2.2 |
| Sodium chloride | 0.2 |
| Water | 11.5 |
| Remainder | 0.1 |

The fatty acid soap consisted of a mixture of tallow and coconut soaps in the proportion of tallow to coconut of 82:18. The fatty acid moiety of the fatty acyl isethionate was derived from coconut oil. The free fatty acids were a mixture of stearic acid and coconut free fatty acids in the proportion of stearic acid to coconut acids of 84:16. The remainder included antioxidants.

EXAMPLE 4

A 200 g batch of the composition was admixed :n a Winkworth sigma blade mixer at a temperature of 60° C. so as to yield a composition containing 15 wt % water.

The procedure of Example 1 was then followed. The results are shown graphically in FIG. 4 which is a plot of mixing time in minutes against intensity in counts per second of the X-ray diffraction peaks attributable to the presence of soap delta phase. As can be seen, the delta phase was first detected after 10 minutes working and its concentration steadily increased with continued working.

EXAMPLE 5

Five batches of the present composition were employed in the present example. Four batches were air-dried to moisture contents of 8.1 wt %, 8.9 wt %, 10.1 wt % and 11.1 wt % respectively. The fifth batch was admixed in the Winkworth mixer at 60° C. with a little water so as to achieve a moisture content of 11.8 wt %.

Each batch was then worked in the Winkworth mixer at 25° C. for 45 minutes at 30rpm.

Figure 5:
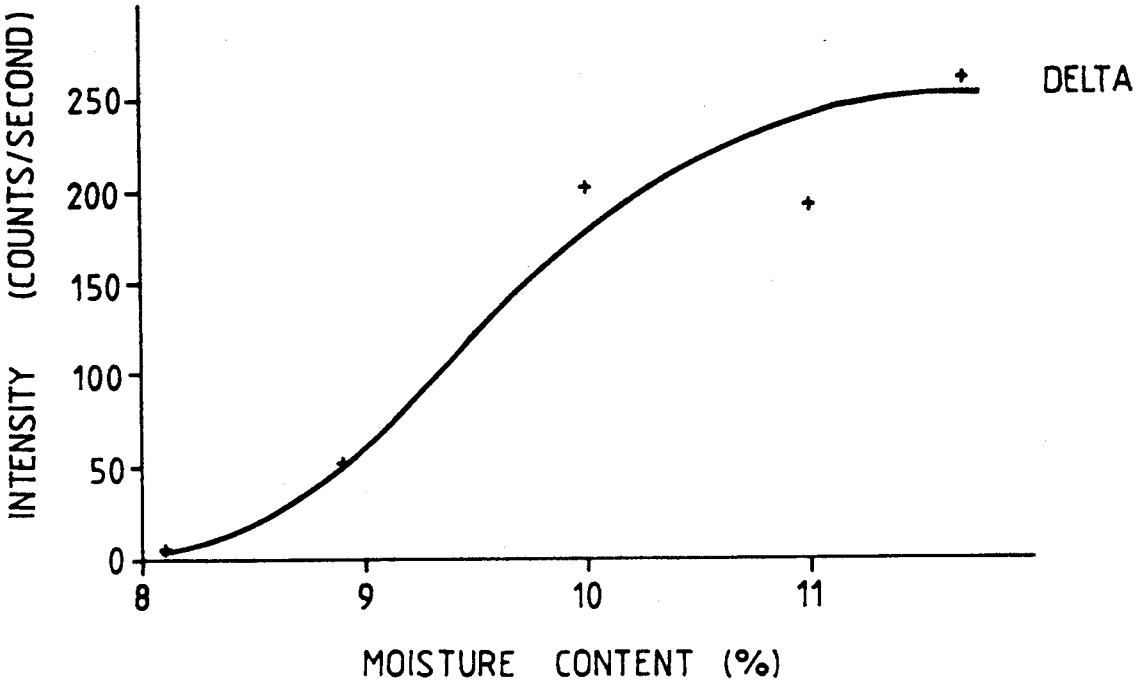

The results are shown graphically in FIG. 5 which is a plot of moisture content in wt % against intensity in counts per second of the X-ray diffraction peaks attributable to the presence of soap delta phase. As can be seen the threshold moisture content for delta phase generation in the present composition is about 8 wt % and the composition reaches saturation at about 12 wt % moisture.

EXAMPLE 6

The temperature of working the present composition, with a moisture content reduced to 10 wt % has been investigated according to the procedure of Example 3. The temperatures employed in the series were 27.5° C., 32.5° C., 35° C., 40° C., 47° C. and 60° C. respectively on the six batches employed.

Figure 6:
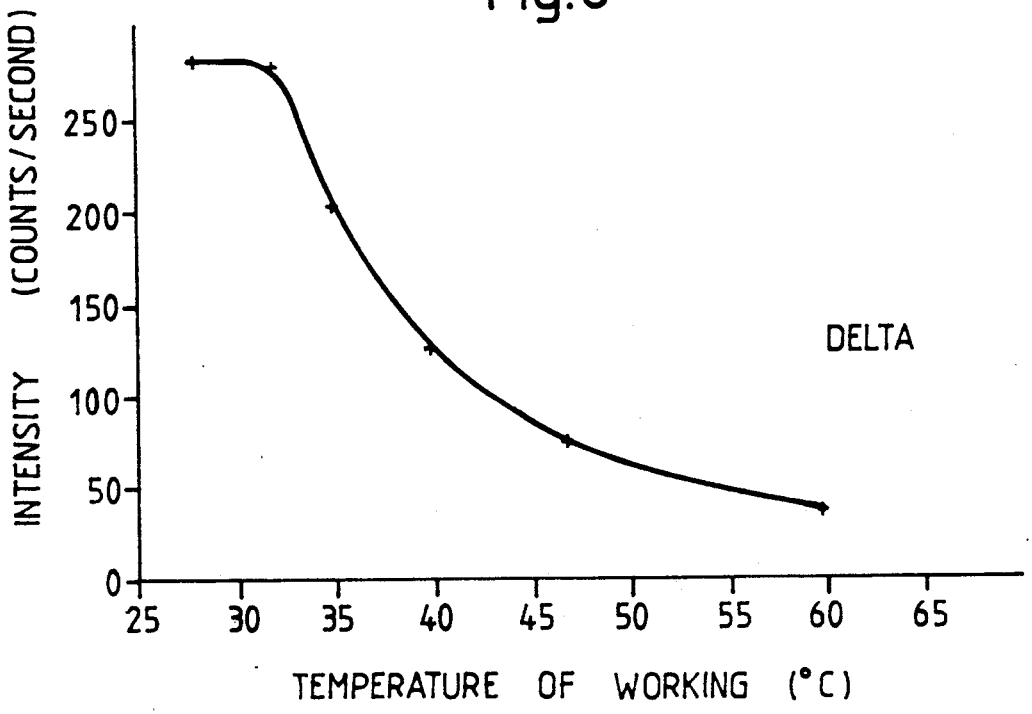

The results are shown graphically in FIG. 6 which is a plot of temperature of working in ° C. against intensity in counts per second of the X-ray diffraction peaks attributable to delta phase soap. As can be seen the generation of delta phase soap appeared to reach a maximum at or below about 32° C.

EXAMPLES 7 TO 13

The composition set out under Examples 1 to 3 was employed in a series of experiments in which the composition was subjected to shear by passing it through a cavity transfer mixer.

The ingredients of the composition were initially roughly mixed and then passed through a cavity transfer mixer at 70° C. in order to homogenise the blend. To some batches extra amounts of water were added to produce test compositions having a range of moisture contents.

Each blend was then passed through a cavity transfer mixer under a set of conditions of temperature and shear energy input. The cavity transfer mixer employed was of the cylindrical type shown in FIG. 1 of GB 2118854. The mixer had a rotor radius of 2.54 cm with 36 hemispherical cavities each with a radius of 1.25 cm and arranged in six rows of six cavities. The inner surface of the stator had seven rows of six cavities. Thermal control was provided by a jacket in contact with the outer surface of the stator and a conduit positioned within the rotor. Glycol was employed as the heat exchange medium. The specified exit temperature for the extruded material governed the throughput and rotor speed which were in the ranges 250 to 500 g $min^{-1}$ and 50 to 150 rpm respectively.

Each batch so treated was then assessed by X-ray diffraction for the amount of delta phase present. The conditions employed and the results are given in Table III below.

TABLE III

| Example | Temperature CTM (°C.) | Water content (wt %) | X-ray diffraction intensity (counts/s) |
|---|---|---|---|
| 7 | 25 | 11.2 | 0 |
| 8 | 28 | 11.3 | 0 |
| 9 | 30 | 12.2 | 109 |
| 10 | 33 | 11.8 | 134 |
| 11 | 35 | 12.7 | 136 |
| 12 | 35 | 12.1 | 72 |
| 13 | 70 | 11.4 | 0 |

The results in Table III show that delta phase soap was only generated in Examples 9, 10, 11 and 12 i.e. when the moisture content of the composition is more than 11.5 wt % and the composition as it passes through the CTM is maintained at a temperature not greater than 35° C.

Each of the products of Examples 7 to 13 was formed into a bar by subjecting the mixture exiting from the CTM to milling, plodding and stamping. Each bar was assessed for its mush properties and its lather generation. The results are given in Table IV below.

TABLE IV

| | Mush | | Lather |
|---|---|---|---|
| Example | Obj. g/50 $cm^2$ | Sub. | Vol. ($cm^3$) |
| 7 | 10.5 | 10.0 | 59.6 |
| 8 | 10.2 | 6.2 | 56.3 |
| 9 | 9.4 | 7.5 | 64.4 |
| 10 | 9.5 | 9.7 | 56.1 |
| 11 | 8.0 | 6.5 | 56.2 |
| 12 | 9.2 | 10.3 | 57.0 |
| 13 | 11.4 | 24.8 | 49.0 |

The results show that a bar comprising the present composition in which at least some of the soap present is in the delta phase (i.e. Examples 8, 9, 10 and 11) has decreased mush tendency and increased lather compared to bars comprising a similar composition but not having some of the soap phase in the delta phase (i.e. Examples 7, 12 and 13). The objective mush test comprised leaving a bar in water for a predetermined time and at a predetermined temperature and scraping from a 50 $cm^2$ area and determining the weight of bar material lost. Thus the less material removed the less the mush rating scored. The subjective mush test comprised twisting each bar 18 times in gloved hands after immersion in a bowl of water at 30° C. The procedure is repeated 8 times a day for 4 days by a panel of testers. At the end of the fourth day, the bars are left overnight in a drained tray. On the fifth day, the face of the bar which has been in contact with the tray is prodded by an experienced worker. The number score given in the table reflects the depth and area of indentation achieved, the higher the number, the greater the indentation and hence the worse the mush properties.

We claim:

1. A cleaning composition comprising:

(a) a fatty acid soap in an amount between 20 and 80 wt % of the composition, (b) a non-soap detergent active which is a $C_8$ to $C_{18}$ fatty acyl isethionate, in an amount between 10 and 60 wt % of the composition; and (c) 1 to 6 wt % of at least one electrolyte, selected from the group consisting of sodium isethionate, sodium chloride, sodium sulphate, sodium carbonate and mixtures thereof;

wherein at least some of said soap is in the delta phase, the minimum amount of said delta phase characterized by a total peak intensity of at least 50 counts/second.

2. A composition according to claim 1 containing 1 to 20 wt % fatty acids.

3. A composition according to claim 2 wherein the fatty acids are selected from the group consisting of lauric acid, palmitic acid, stearic acid and mixtures thereof.

4. A composition according to claim 1 wherein the fatty acid soap present is a mixture of tallow soap and coconut oil soap.

5. A process for making a cleaning composition comprising subjecting a high shear energy a mixture maintained at a temperature of less than 40° C. and containing between 20 and 80 wt % fatty acid soap, between 10 and 60 wt % non-soap detergent active which is a $C_8$ to $C_{18}$ fatty acyl isethionate and sufficient water to ensure the generation of at least some soap in a delta phase, the minimum amount of said delta phase characterized by a total peak intensity of at least 50 counts/second.

6. A process according to claim 5 wherein the composition contains at least 8 wt % water.

7. A process according to claim 5 wherein the composition contains at least 11 wt % water and at least 5 wt % electrolytes.

8. A process according to claim 5 wherein the composition is subjected to high shear energy by passage through a cavity transfer mixer.

* * * * *